US009751103B2

(12) United States Patent
Ferrara

(10) Patent No.: US 9,751,103 B2
(45) Date of Patent: Sep. 5, 2017

(54) VARNISHING PLANT FOR BODY SHOPS

(71) Applicant: Salvatore Ferrara, La Cassa (IT)

(72) Inventor: Salvatore Ferrara, La Cassa (IT)

(73) Assignee: SALVATORE FERRARA, La Cassa (Turin) (IT)

( * ) Notice: Subject to any disclaimer, the term of this patent is extended or adjusted under 35 U.S.C. 154(b) by 23 days.

(21) Appl. No.: 14/875,860

(22) Filed: Oct. 6, 2015

(65) Prior Publication Data

US 2016/0101431 A1 Apr. 14, 2016

(30) Foreign Application Priority Data

Oct. 13, 2014 (IT) ..... TO2014A0822

(51) Int. Cl.
*B05B 15/12* (2006.01)

(52) U.S. Cl.
CPC ..... *B05B 15/1296* (2013.01); *B05B 15/1222* (2013.01); *B05B 15/1248* (2013.01)

(58) Field of Classification Search
USPC ..... 118/326, 309, 634, 50; 454/50–55; 52/36.1
See application file for complete search history.

(56) References Cited

U.S. PATENT DOCUMENTS

| | | | | |
|---|---|---|---|---|
| 3,898,918 | A * | 8/1975 | Carter | B29C 53/60 138/93 |
| 4,499,911 | A * | 2/1985 | Johnson | A24B 1/02 131/302 |
| 2013/0337733 | A1* | 12/2013 | Williams | B05B 15/1222 454/52 |

FOREIGN PATENT DOCUMENTS

| | | | |
|---|---|---|---|
| DE | 102006001384 | A1 | 7/2007 |
| EP | 0422980 | A1 | 4/1991 |
| FR | 2692028 | A1 | 12/1993 |
| WO | 2012016637 | A1 | 2/2012 |
| WO | 2012085535 | A1 | 6/2012 |

OTHER PUBLICATIONS

Italian Search Report and Written Opinion dated Oct. 13, 2014 for Application No. TO2DD014A000822.

* cited by examiner

*Primary Examiner* — Yewebdar Tadesse

(74) *Attorney, Agent, or Firm* — Patterson & Sheridan, LLP

(57) ABSTRACT

A varnishing plant comprising: a platform on which a plurality of work stations are defined, each of which is adapted to receive a vehicle, a spray booth movable on the platform and positionable on each of said work stations, and an air supply and extraction system associated with the spray booth, wherein said air supply and extraction system comprises a fresh air intake duct and a polluted air exhaust duct, stationary and communicating with an external environment, wherein the polluted air exhaust duct communicates with air suction volumes located below said platform, wherein said fresh air intake duct has a plurality of openings located at respective work stations, and wherein the spray booth comprises a fresh air suction mouth selectively connectable to the opening located at the work station on which the spray booth is located.

6 Claims, 6 Drawing Sheets

VARNISHING PLANT FOR BODY SHOPS

CROSS-REFERENCE TO RELATED APPLICATIONS

This application claims benefit of Italian patent application number TO2014A000822, filed Oct. 13, 2014, which is herein incorporated by reference.

BACKGROUND OF THE INVENTION

1. Field of the Invention

The present invention relates to a varnishing plant, in particular for body shops.

2. Description of Prior Art

The bodies shops for the repair of vehicles are usually provided with a plurality of work stations in which repair operations, such as removal of body parts, removal of damaged mechanical components, mounting of body panels, mounting or replacing of repaired mechanical components, etc., are carried out. After carrying out the repair operations, the vehicle is moved inside a spray booth in which varnishing and drying operations are carried out. The spray booth must be provided with a system for the extraction of polluted air and for the supply of fresh air, to avoid contamination of the work environment by the sprayed paint.

In traditional body shops the spray booths are stationary and the vehicles are moved between repair stations and spray booths. The movement of vehicles within a bodywork involve a considerable waste of time.

Document WO2012/085535 describes a movable spray booth which forms a controlled environment for the spraying process. The spray booth is mounted on a support rail and is movable along the rail to be positioned at different work stations. This solution reduces the number of movements of vehicles within the body shop. In fact, the vehicles to be repaired are positioned in respective work stations where repair operations are carried out. After completing the repair, the booth is positioned on the workstation without moving the vehicle. The movable spray booth described in WO2012/085535 comprises a ventilation system placed on the roof of the booth that draws an air flow from the internal environment of the body shop, sends it inside the spray booth and extracts from the spray booth a flow of polluted air that is released into the internal environment of the body shop after a filtration.

One of the main problems of the solution known from WO2012/085535 is that the ventilation system of the spray booth does not meet the standards, which require that the circulation of air inside the booths should be carried out with air drawn from outside the building. Furthermore, the air supply and exhaust system described in this document is not able to ensure effective air change inside the spray booth as the supply and extraction of air take place in correspondence of the upper wall of the spray booth, so it is likely that in use a part of the flow of fresh air is recirculated to the exhaust system without carrying out an effective air exchange within the spray booth.

SUMMARY OF THE INVENTION

The object of the present invention is to provide a varnishing plant which overcomes the problems of the prior art.

According to the present invention, this object is achieved by a varnishing plant comprising:

a platform on which a plurality of work stations are defined, each of which is adapted to receive a vehicle, a spray booth movable on the platform and positionable on each of said work stations, and an air supply and extraction system associated with the spray booth, wherein the air supply and extraction system comprises a fresh air intake duct and a polluted air exhaust duct, stationary and communicating with an external environment, wherein the polluted air exhaust duct communicates with air suction volumes located below said platform, wherein said fresh air intake duct has a plurality of openings located at respective work stations, and wherein the spray booth comprises a fresh air suction mouth selectively connectable to the opening located at the work station on which the spray booth is located.

The claims are an integral part of the teaching provided in relation to the invention.

BRIEF DESCRIPTION OF THE DRAWINGS

The present invention will now be described in detail with reference to the accompanying drawings, provided purely by way of non-limiting example, in which.

DETAILED DESCRIPTION

Figure 1:
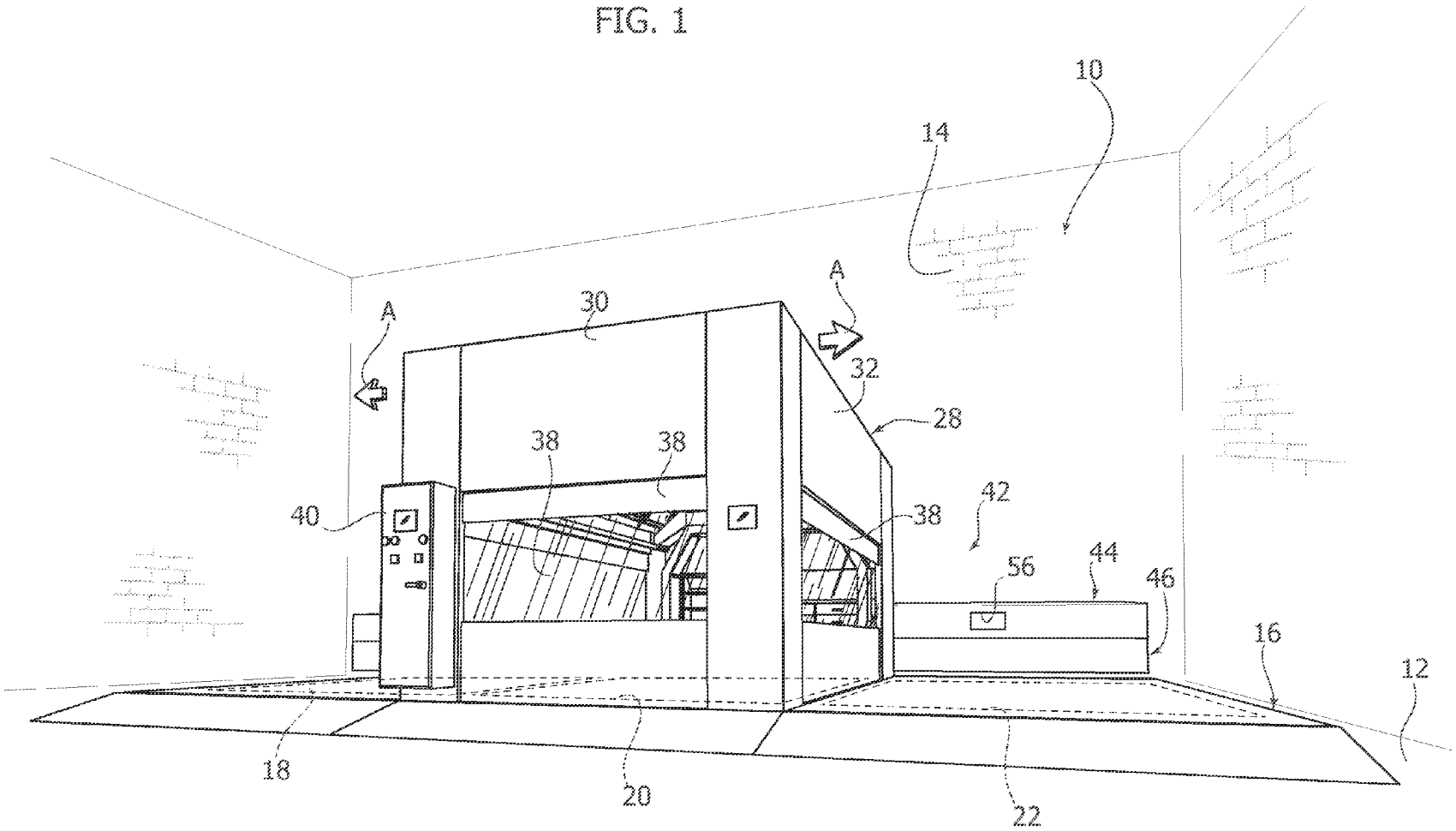
FIG. 1 is a perspective view of a varnishing plant according to the present invention.

With reference to FIG. 1, numeral 10 designates a varnishing plant according to the present invention. The varnishing plant 10 is intended to be installed inside a closed building having a floor 12 and a peripheral wall 14 that divides the interior of the building from the external environment.

Figure 2:
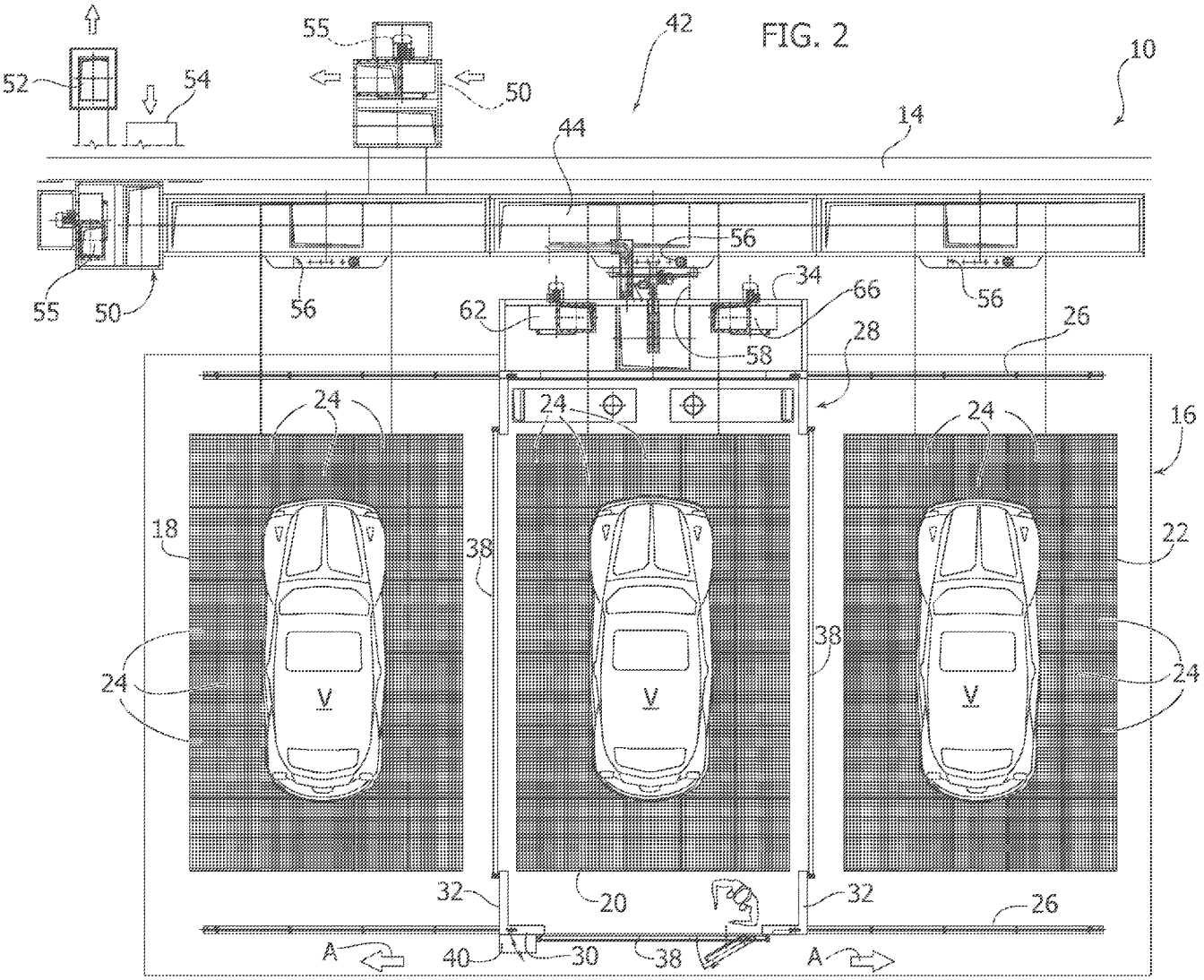
FIG. 2 is a plan view of the plant of FIG. 1.

The varnishing plant 10 comprises a platform 16 fastened to the floor 12, on which a plurality of work stations 18, 20, 22 are defined, each of which is adapted to receive a vehicle V. In FIGS. 1 and 2, the work stations 18, 20, 22 have been schematically represented with dashed rectangles. The illustrated example shows three work stations parallel to each other but it is understood that the present invention is applicable to varnishing plants with any number and arrangement of work stations.

The platform 16 has a horizontal floor which can be slightly raised from the floor 12 of the building. As shown in FIG. 2, the platform floor 16 can be formed by grid shaped metal panels 24 at least in correspondence of the work stations 18, 20, 22. Again with reference to FIG. 2, the platform 16 is provided with two parallel rails 26 on opposite sides of the work stations 18, 20, 22 and with a length approximately equal to the overall extension in the transverse direction of the work stations 18, 20, 22.

Figure 3:
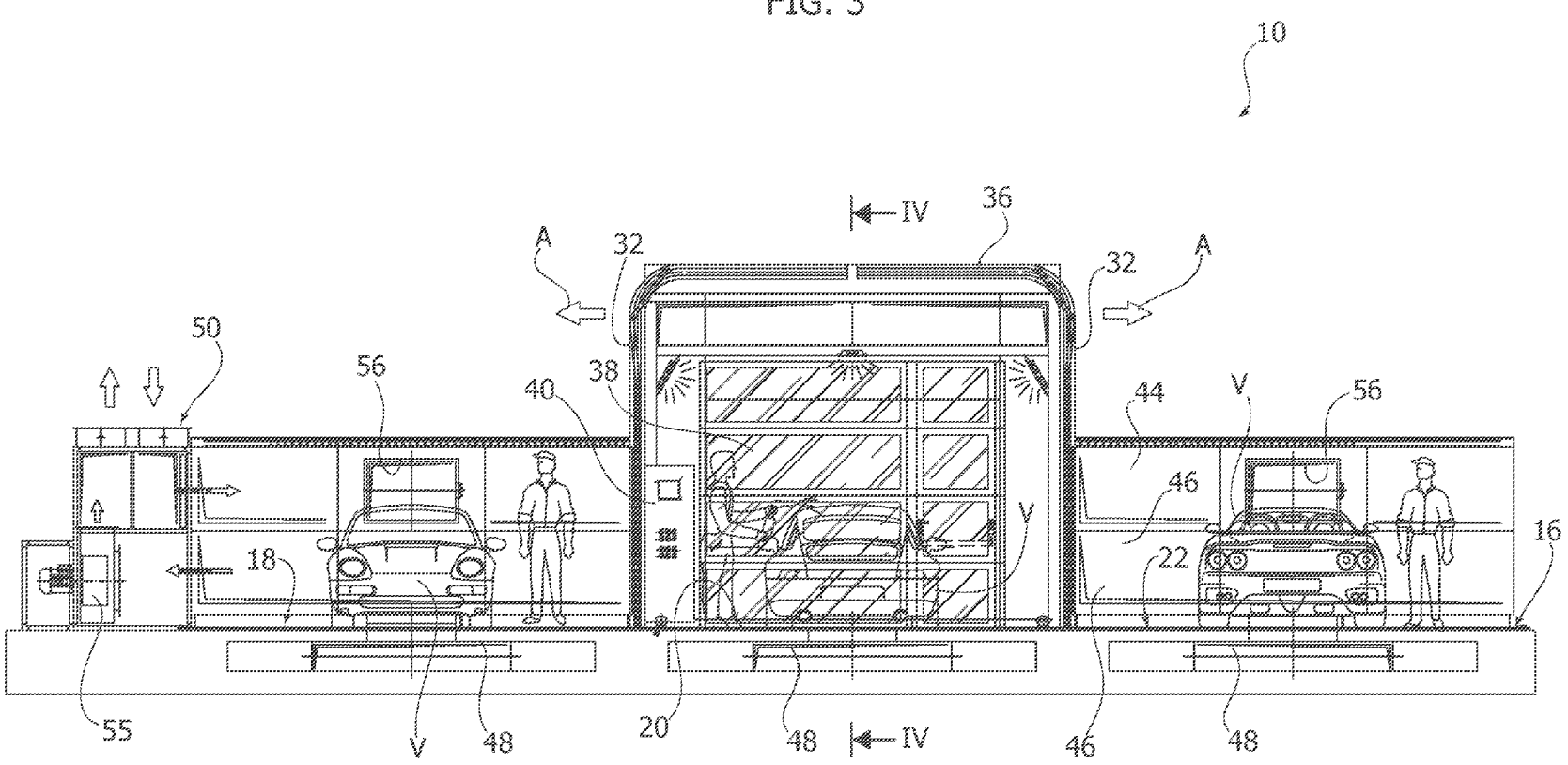
FIG. 3 is a front view of the plant of FIG. 1.
Figure 4:
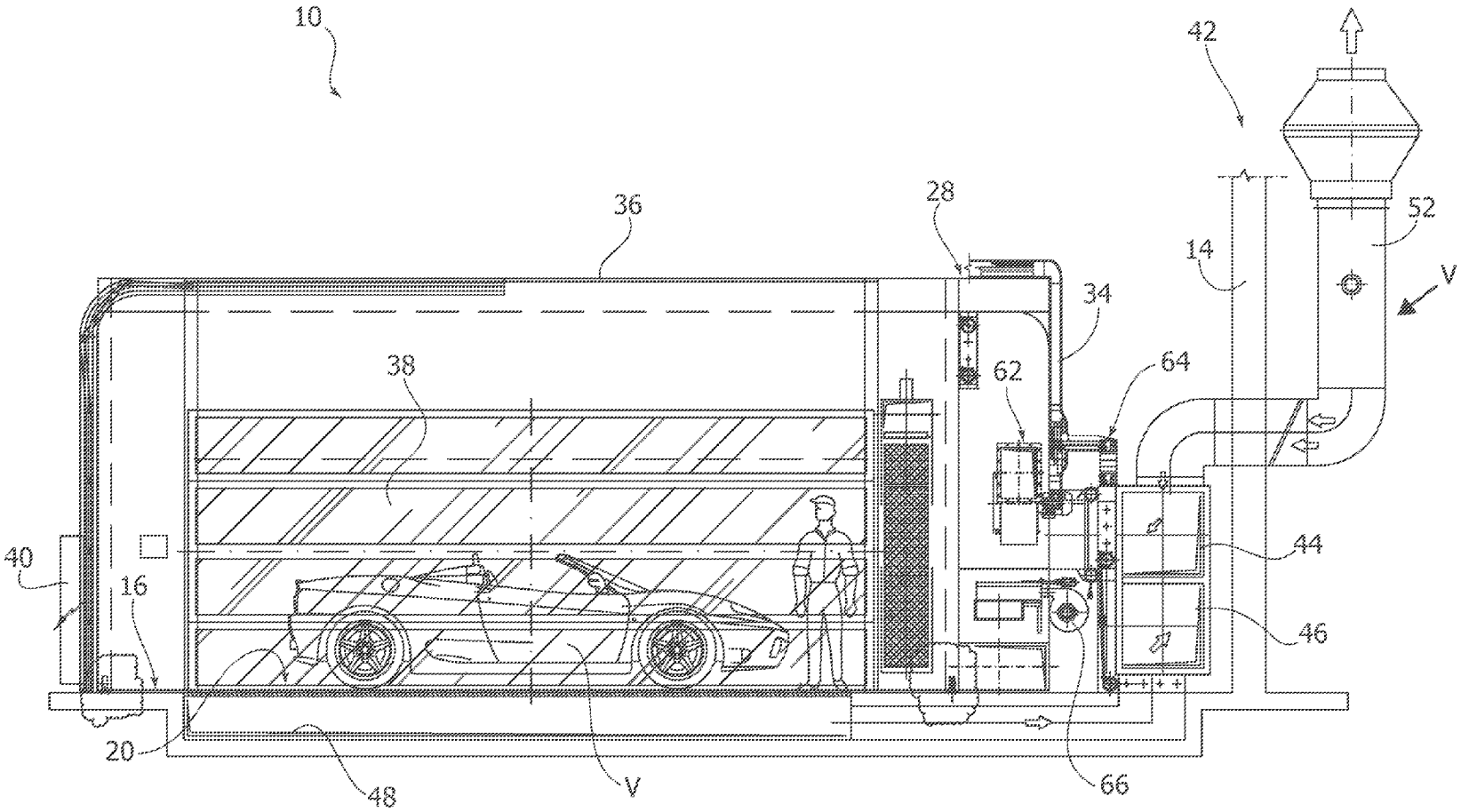
FIG. 4 is a section along the line IV-IV of FIG. 3.

The varnishing plant 10 includes a spray booth 28 which is provided with wheels which engage the rails 26 of the platform 16. The spray booth 28 is movable along the rails 26 in the direction indicated by the arrows A in FIGS. 1 and 3 and can be positioned above each of the work stations 18, 20, 22. The spray booth 28 has a substantially parallelepiped shape, with a front wall 30, two side walls 32, a rear wall 34 and a top wall 36. The front wall 30 and the side walls 32 are provided with openings closed by vertical sliding doors 38 that can be formed by flexible curtains or shutters. The bottom of the spray booth 28 is open, whereby the spray booth 28 with the doors 38 of the side walls 32 raised is free to move in the transverse direction above the vehicles V located on the work stations 32. Inside the spray booth 28 there is located a drying arc provided with heating elements and movable in the longitudinal direction inside the spray booth 28 along an overhead guideway. The drying arc is controlled by a control unit 40 carried by the spray booth 28. The drying arc may have a structure substantially identical to that of the drying arcs of stationary spray booths of known type.

The varnishing plant 10 comprises an air intake and extraction system 42 adapted to perform a replacement of air within the spray booth 28 in any position of the spray booth 28. The air intake and extraction system 42 comprises a fresh air intake duct 44 and a polluted air exhaust duct 46, both communicating with the outside of the building in which the varnishing plant 10 is installed. In the embodiment illustrated in the figures, the fresh air intake duct 44 and the polluted air exhaust duct 46 are straight ducts of folded sheet metal with square cross section and which extend one above the other parallel to the direction of movement of the spray booth 28 on the inner side of the peripheral wall 14. It is of course understood that the ducts 44, 46 can have any shape and may be arranged in any way, not necessarily parallel to the direction of movement of the spray booth 28.

The polluted air exhaust duct 46 communicates with a polluted air suction volume 48 located below the work stations 18, 20, 22, and in communication with the internal environment of the building via the grid shaped perforated surfaces of the metal panels 24 forming the floor of the platform 16. Filtering material may be disposed in the polluted air suction volume 48. The air intake and extraction system 42 comprises an intake/exhaust unit 50 formed by a metal casing located on the inner side of the peripheral wall 14 at one end of the ducts 44, 46. Alternatively, the intake/exhaust unit 50 may be disposed on the outer side of the peripheral wall 14 in any position along the length of the ducts 44, 46. In FIG. 2 a solid line shows an intake/exhaust unit 50 located inside the building and a dotted line shows an intake/exhaust unit 50 located outside. When the intake/exhaust unit 50 is located inside the building it communicates with the outside through an external exhaust duct 52 and an external intake duct 54, which extend through the peripheral wall 14. In the case in which the intake/exhaust unit 50 is located outside it communicates with the fresh air intake duct 44 and with the polluted air exhaust duct 46 through duct sections extending through the peripheral wall 14. The intake/exhaust unit 50 contains an exhaust fan 55 which sucks an air flow from the polluted air exhaust duct 46 and sends it to the external environment. The intake/exhaust unit 50 may also be equipped with filters for the flow of fresh air coming from the outside.

The fresh air intake duct 44 communicates with the external environment through the intake/exhaust unit 50. The fresh air intake duct 44 has a plurality of openings 56 located at respective work stations 18, 20, 22. The openings 56 are preferably closed by respective openable doors. The openable doors associated to the openings 56 can be opened manually or by motorized devices.

Figure 5:
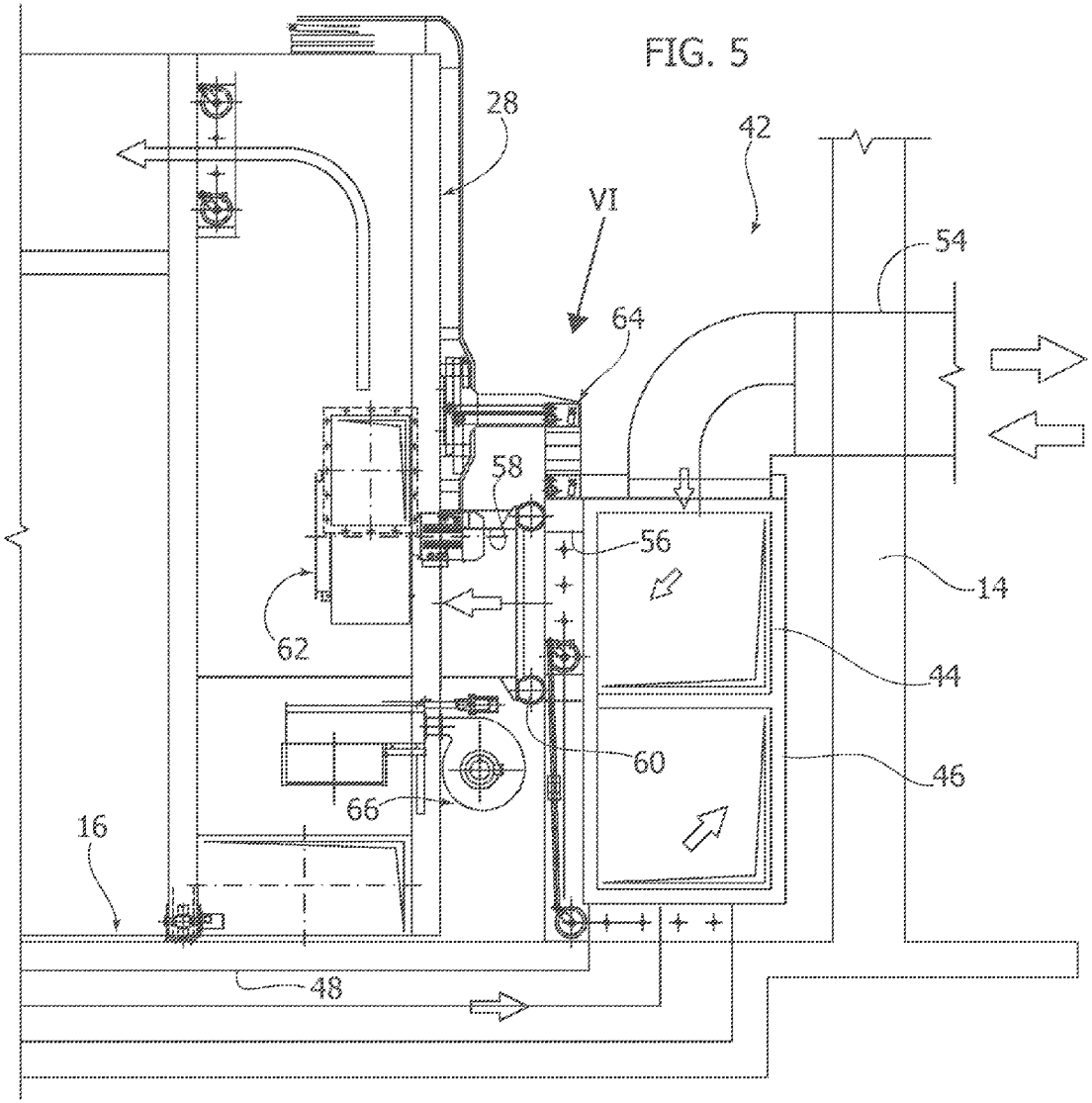
FIG. 5 is an enlarged view of the part indicated by the arrow V in FIG. 4.
Figure 6:
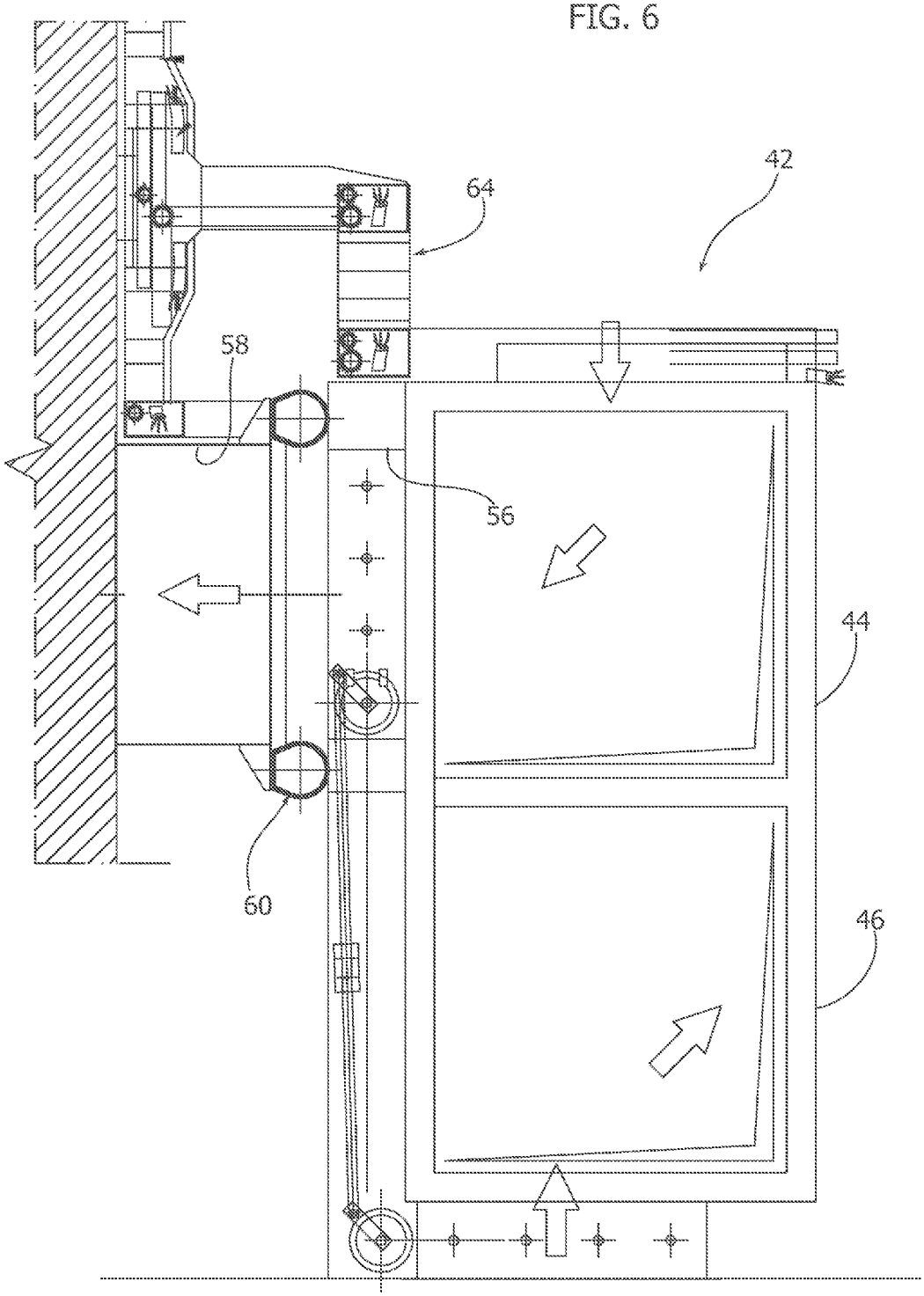
FIG. 6 is an enlarged detail of the part indicated by the arrow VI in FIG. 5.

With reference in particular to FIGS. 5 and 6, the spray booth 28 comprises a suction mouth 58 selectively connectable to the opening 56 situated at the working station 18, 20, 22 on which the spray booth 28 is positioned. The suction mouth 58 of the spray booth 28 faces frontally a respective opening 56 of the fresh air intake duct 44 as a result of the movement in the transverse direction of the spray booth 28. When the spray booth 28 is properly positioned on a respective work station 18, 20, 22, the suction mouth 58 faces the front opening 56 situated at the respective work station 18, 20, 22. The suction mouth 58 is provided with a front seal 60 which establishes a sealing contact with the front wall of the fresh air intake duct 44 around the opening 56. The front seal 60 surrounds the front side of the suction mouth 58 and is formed by an internally hollow ring which can be pressurized by compressed air. When the front seal 60 is not pressurized a play of several centimeters is present between the front seal 60 and the front wall of the fresh air intake duct 44. In pressurized conditions the front seal 60 is pressed against the front wall of the fresh air intake duct 44. The end seal 60 may for example have a thickness of 40 mm in non-pressurized condition and a thickness of 100 mm in a pressurized condition. The supply pressure of the end seal may be for example of 0.4 bars and comes from the compressed air circuit of the spray booth 28.

The paint booth 28 carries a fresh air supply fan 62 which feeds a flow of fresh air from an intake 58 and sends it to a fresh air distribution system located within the spray booth 28.

The coating system 10 includes a cable chain 64 lying parallel to the ducts 44, 46. The cable chain 64 connects the electrical system aboard the booth 28 with the power grid of the building. The cable chain 64 can also connect the spray booth 28 to compressed air tubes or tubes supplying natural gas to the drying arc. The spray booth 28 can also be provided with a burner 66 fed with natural gas for heating the internal volume of the spray booth 28.

In use, the vehicles V are placed on the work stations 18, 20, 22 where they are subjected to repair operations such as disassembly/assembly, replacement of damaged body parts, repair or replacement of mechanical components, etc. At the end of the repair operations, the vehicle is not moved from the work station 18, 20, 22 on which it is positioned. To perform the varnishing operation, the paint booth 28 is moved in the direction A and positioned on the work station 18, 20, 22 on which the vehicle V that must be subjected to varnishing operations is located. During the travel of the booth 28, the doors 38 of the side walls 32 are raised. When the spray booth 28 is correctly positioned on the work station 18, 20 or 22 the spray booth 28 is blocked and the doors 38 are lowered. The suction mouth 58 of the spray booth 28 is connected to the intake duct 44 through the opening 56 facing the suction mouth 58. The fresh air supply fan 62 of the spray booth 28 draws a flow of fresh air from outside the building and distributes it inside the spray booth 28. At the same time, the exhaust fan 55 of the intake/exhaust unit 50 draws a flow of polluted air through the floor of the platform 16 and sends it outside the building through the exhaust duct 52. In the spray booth 28 varnishing and drying operations are carried out in an environment isolated from the inside volume of the building, without the risk of contamination of the inside volume of the building with paint sprayed inside the booth 28. Within the spray booth 28 the flow of fresh air moves from top to bottom, and carries out a complete washing of the paint in suspension in the air.

The coating system according to the present invention eliminates displacements and movements of the vehicles inside the body shop during all phases of repair. The vehicles once positioned in the assigned work station will not be handled until the end of the operations. This also allows a reduction in the number of booths installed in a body shop relative to conventional plants with stationary booths.

Of course, without altering the principle of the invention, the details of construction and forms of embodiment may be varied widely with respect to those described and illustrated without thereby departing from the scope of the invention as defined in the claims which follow.

The invention claimed is:

1. A varnishing plant comprising:

a platform having a perforated floor, an air suction volume located below said perforated floor, a plurality of work stations defined on said perforated floor, a spray booth movable on the platform and selectively positionable on a selected one of said plurality of work stations, an extraction system comprising a stationary exhaust duct communicating at a first end with said air suction volume and at a second end with an external environment, and a stationary fresh air intake duct having a plurality of air intake openings facing respective work stations, wherein the spray booth comprises a fresh air suction mouth selectively connectable to one of the plurality of air intake openings facing one of the plurality of work stations on which the spray booth is located.

2. The varnishing plant according to claim 1, wherein said stationary fresh air intake duct and said stationary exhaust duct communicate with an intake/exhaust unit located in an indoor environment, and communicating with an external environment via an outer exhaust duct and an outer intake duct.

3. The varnishing plant according to claim 1, wherein said stationary fresh air intake duct and said stationary exhaust duct communicate with an intake/exhaust unit located in an outside environment.

4. The varnishing plant according to claim 1, wherein said fresh air suction mouth is provided with a front seal which establishes a sealing contact with a front wall of the stationary fresh air intake duct around a corresponding opening.

5. The varnishing plant according to claim 4, wherein said front seal has a cavity which can be pressurized to move the front seal between a sealing position and a disengagement position.

6. The varnishing plant according to claim 1, wherein said plurality of air intake openings of said stationary fresh air intake duct are closed by respective openable doors.

* * * * *